US007388596B2

(12) United States Patent
Chung

(10) Patent No.: US 7,388,596 B2
(45) Date of Patent: Jun. 17, 2008

(54) METHOD AND APPARATUS OF DRIVING A THERMAL PRINT HEAD TO FORM AN IMAGE

(75) Inventor: Jin-tae Chung, Gunpo-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 238 days.

(21) Appl. No.: 11/289,548

(22) Filed: Nov. 30, 2005

(65) Prior Publication Data

US 2006/0125908 A1 Jun. 15, 2006

(30) Foreign Application Priority Data

Dec. 15, 2004 (KR) ..... 10-2004-0106540

(51) Int. Cl.
*B41J 2/32* (2006.01)
*B41J 2/355* (2006.01)

(52) U.S. Cl. ..... 347/182

(58) Field of Classification Search ..... 347/180–182; 400/120.05, 120.06
See application file for complete search history.

(56) References Cited

U.S. PATENT DOCUMENTS 5,075,701 A * 12/1991 Arai ..... 347/210
6,296,405 B1 * 10/2001 Brewington et al. ..... 400/188
6,417,877 B2 * 7/2002 Oishi ..... 347/182
7,179,002 B2 * 2/2007 Lee et al. ..... 400/120.17
7,198,419 B2 * 4/2007 Lee ..... 400/120.16

FOREIGN PATENT DOCUMENTS

| | | |
|---|---|---|
| JP | 60-122169 | 6/1985 |
| JP | 63-265668 | 11/1988 |
| JP | 02-117856 | 5/1990 |
| JP | 04-220372 | 8/1992 |
| JP | 05-208515 | 8/1993 |
| JP | 07-052437 | 2/1995 |
| JP | 09-193438 | 7/1997 |
| JP | 2001-232841 | 8/2001 |

* cited by examiner

*Primary Examiner*—Huan H Tran
(74) *Attorney, Agent, or Firm*—Roylance, Abrams, Berdo & Goodman, L.L.P.

(57) ABSTRACT

A method and apparatus are provided for driving heaters of a thermal print head in a thermal image transfer. The method divides each of the heaters, which consecutively print at least two color images, into a predetermined number of groups of multiple heaters. The heaters in each group consecutively printing a first color image. When printing an image by consecutively printing more than two color images, the heating order is divided into 12 phases and the image is sequentially printed. Power consumed in driving the heaters is therefore reduced.

15 Claims, 6 Drawing Sheets

METHOD AND APPARATUS OF DRIVING A THERMAL PRINT HEAD TO FORM AN IMAGE

This application claims the benefit under 35 U.S.C. § 119(a) of Korean Patent Application No. 10-2004-0106540, filed on Dec. 15, 2004 in the Korean Intellectual Property Office, the entire disclosure of which is hereby incorporated by reference.

BACKGROUND OF THE INVENTION

1. Field of the Invention

The present invention relates to thermal image transfer. More particularly, the present invention relates to an apparatus and method of driving a thermal print head wherein an image is formed by consecutively printing at least two color images. The images are printed using a plurality of heaters within the thermal print head. The heaters are used in a heating order that is organized into phases to print the image sequentially.

2. Description of the Related Art

Generally, an image forming apparatus converts a document written by a user via an application program, or an image photographed with, for instance, a digital camera, into encoded data. The image forming apparatus outputs the encoded data onto printing media making it visible to the user.

A thermal transfer printer produces an image by applying heat onto an ink ribbon in contact with a printing medium by using a thermal print head. On application of heat, ink is transferred from the ink ribbon onto the printing medium. Alternatively, another type thermal transfer printer produces an image by applying heat to a printing medium that has an ink layer. A predetermined color is produced in response to heat provided by a thermal print head.

The thermal print head includes a plurality of heaters having a predetermined resistance R. The heaters supply heat to the printing medium in response to application of a predetermined voltage, VHD. By increasing the number of heaters, an improvement in printing quality can be achieved. Accordingly, the number of control signals required to control operation of the thermal print head increases as the number of heaters increases. Power P consumed by a single heater on application of voltage VHD can be calculated using Equation 1.

$$P = \frac{VHD^2}{R} \tag{1}$$

Therefore, as the number of heaters increases, to obtain high quality images, the power consumed by the thermal print head also increases.

SUMMARY OF THE INVENTION

An embodiment of the present invention provides a method of driving a thermal print head by dividing a plurality of heaters within the thermal print head into a number of phases. The heaters are sequentially activated to consecutively print at least two images in order to reduce power consumption while printing.

According to an aspect of the present invention, there is provided a method of driving a thermal print head. The method includes dividing heaters, which consecutively print at least two color images, into a predetermined number of groups, including multiple heaters. The method further includes; driving the heaters in each of the groups to sequentially print a first color image.

The thermal print head may rotate to face first and second surfaces of the print medium. The thermal print head may consecutively print a yellow image and a magenta image on the medium's first surface by applying heat to the first surface. A cyan image may be printed on the second surface of the medium by applying heat to the second surface.

According to another aspect of the present invention, there is provided a method of driving a thermal print head that includes dividing heaters into a predetermined number of groups, including multiple heaters, to consecutively print images. The method further includes driving the heaters in each of the groups to sequentially print a first image and then print a second image at a different time. In one embodiment the printed images are color.

The thermal print head may rotate to face first and second surfaces of the print medium. When printing in color, the first image may be yellow and the second image magenta.

In driving the heaters, the heaters in each group may be driven to sequentially print the yellow image at predetermined intervals.

The predetermined interval may be a unit of time during which the heater applies heat to the medium. In driving the heaters, a latch signal input to the thermal print head may be delayed as much as the predetermined interval so that the heaters can print the yellow image at the predetermined intervals.

According to another aspect of the present invention, there is provided an image forming apparatus that includes a data input unit to receive image data of an image that is to be printed; a control unit to generate control signals to drive heaters in response to the input image data; and a thermal print head having a plurality of heaters that are divided into a predetermined number of groups. The print head is configured to drive the heaters in response to the control signals. The control unit generates control signals to control the heaters and print at least two color images consecutively. The heaters of each group are controlled to sequentially print a first color image.

The image forming apparatus may further include a location adjusting unit to rotate the thermal print head so that the print head faces a first or a second surface of the print medium.

The control unit may generate control signals to control the heaters in each group to sequentially print a first color image, then print a second color image at a time different than when the first color image was printed.

The control unit may generate signals to control the heaters in each group to sequentially print the yellow image at predetermined intervals. The predetermined interval may be a unit of time during which the heater applies heat to the print medium.

The control unit may generate a latch signal to cause delay equivalent to a predetermined interval so that the heaters can print a yellow image during the predetermined interval.

The method of driving the thermal print head may be embodied in a computer readable medium having stored thereon instructions for driving a thermal print head in accordance with methods and aspects of the present invention.

BRIEF DESCRIPTION OF THE DRAWINGS

The above and other features and advantages of the present invention will become more readily apparent by the detailed description of exemplary embodiments thereof, with reference to the attached drawings, in which.

Throughout the drawings, like reference numbers should be understood to refer to like elements, features, and structures.

DETAILED DESCRIPTION OF EXEMPLARY EMBODIMENTS

Exemplary embodiments of the present invention will now be described more fully with reference to the accompanying drawings.

Figure 1:
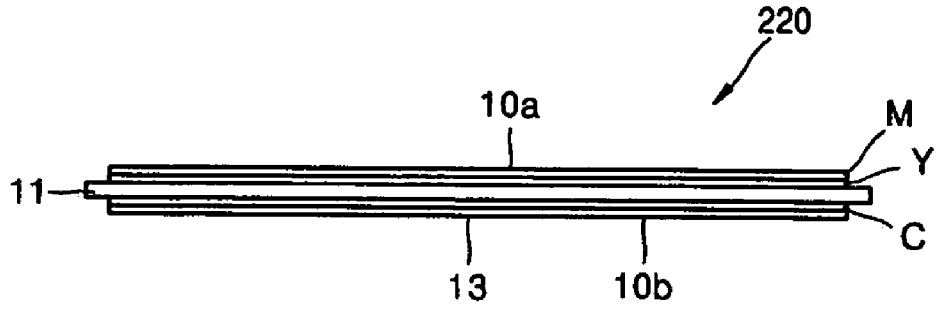
FIG. 1 depicts a cross-section of a heat-sensitive medium according to an embodiment of the present invention.

FIG. 1 depicts a cross-section of a heat-sensitive medium 220 according to an embodiment of the present invention. Medium 220 includes a base sheet 11, which has ink layers of predetermined colors formed on first and second surfaces 10*a* and 10*b*. The ink layers are of different colors. For example, yellow (Y) and magenta (M) layers are sequentially stacked on first surface 10*a*, and a cyan (C) layer is formed on second surface 10*b*. Base sheet 11 may be transparent. A reflective layer 13 formed on the bottom of the second surface 10*b* reflects light onto a color image formed on the first surface 10*a*. In order for yellow and magenta images to be sequentially formed on first surface 10*a*, the yellow image may be produced when a lot of heat is applied to medium 220 for a short period. The magenta image may be produced when a small amount of heat is applied to medium 220 for a long period.

Figure 2:
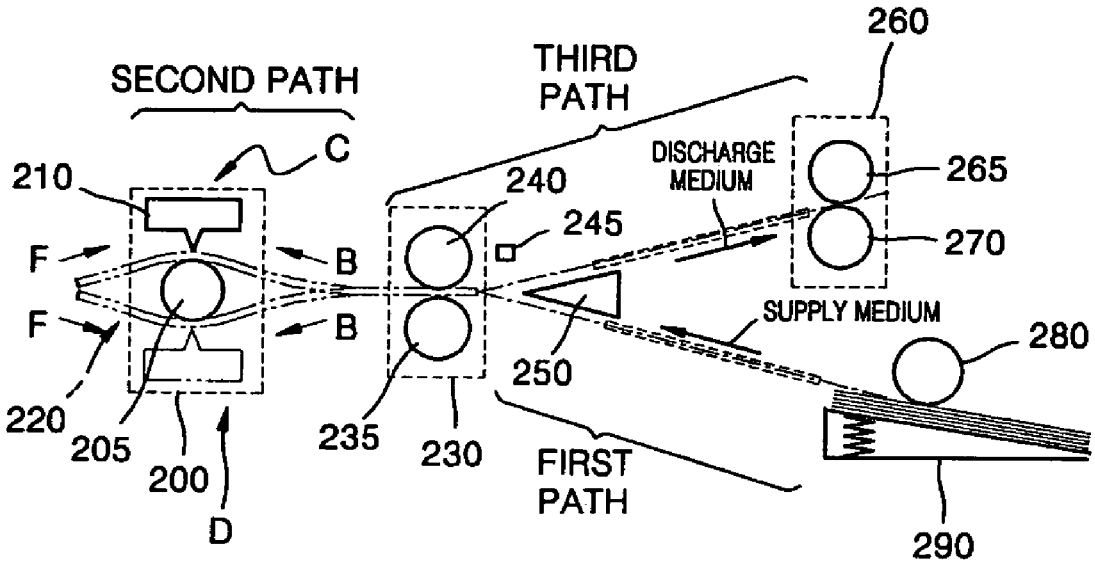
FIG. 2 shows a view of an image forming apparatus that prints two color images consecutively by applying heat onto the medium according to an embodiment of the present invention.

FIG. 2 shows a view of an image forming apparatus that prints two color images consecutively by applying heat to medium 220. The image forming apparatus includes a platen roller 205, a thermal print head 210, a driving unit 230, a driving roller 235, an idle roller 240, an edge detecting sensor 245, a medium guide 250, a discharge unit 260, a discharge slave roller 265, a discharge roller 270, a pickup roller 280, and a medium storage unit 290.

The pickup roller 280 picks up medium 220 from the medium storage unit 290 and transports the medium 220 through a first path to driving roller 235 and idle roller 240. The driving roller 235 and idle roller 240 transport the medium 220 through a second path in a direction B, which is opposite to a direction in which an image is printed. When medium 200 is located at a print start location, the driving roller 235 and the idle roller 240 transport medium 220 through the second path in a printing direction F. Then, a yellow image and a magenta image are consecutively formed on the first surface 10*a* of medium 220 by the thermal print head 210 continuously applying heat thereto.

A third path is for medium 220 to return to the second path by being transported in the direction B to print a cyan image on the second surface 10*b* of medium 220 after the yellow and magenta images are formed on the first surface 10*a* of medium 220. Also, the third path is where medium 220 is transported in the printing direction F to be discharged after printing is completed.

Figure 3:
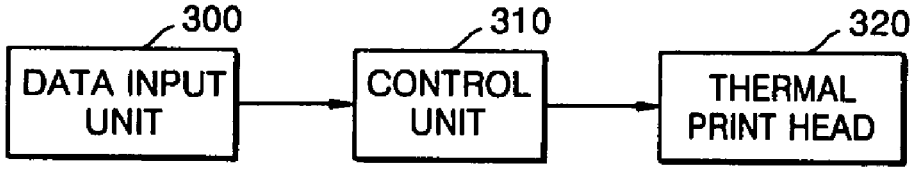
FIG. 3 illustrates a block diagram of an image forming apparatus according to an embodiment of the present invention.

The medium guide 250 guides medium 220 through the first, second, or third path. The edge detecting sensor 245 is used to determine the transport location of medium 220. The thermal print head 210 is placed at a location indicated by arrow D when the thermal print head 210 continuously applies heat to the first surface 10*a* to print yellow and magenta images. The thermal print head 210 may be placed at a location indicated by arrow C when printing the cyan image on the second surface 10*b* of medium 220. The location of thermal print head 210 may be changed by rotating about an axis of platen roller 205 FIG. 3 illustrates a block diagram of an image forming apparatus according to an embodiment of the present invention. The image forming apparatus includes a data input unit 300, a control unit 310, and a thermal print head 320.

The data input unit 300 receives image data from, for example, a personal computer (PC), a digital camera, or a personal digital assistant (PDA).

The control unit 310 generates control signals to control the operation of the thermal print head 320 according to the input image data. The thermal print head 320 receives control signals from the control unit 310 and drives a plurality of heaters 400, 410, and 420, shown in FIG. 4, to apply heat to medium 220 to print an image.

Figure 4:
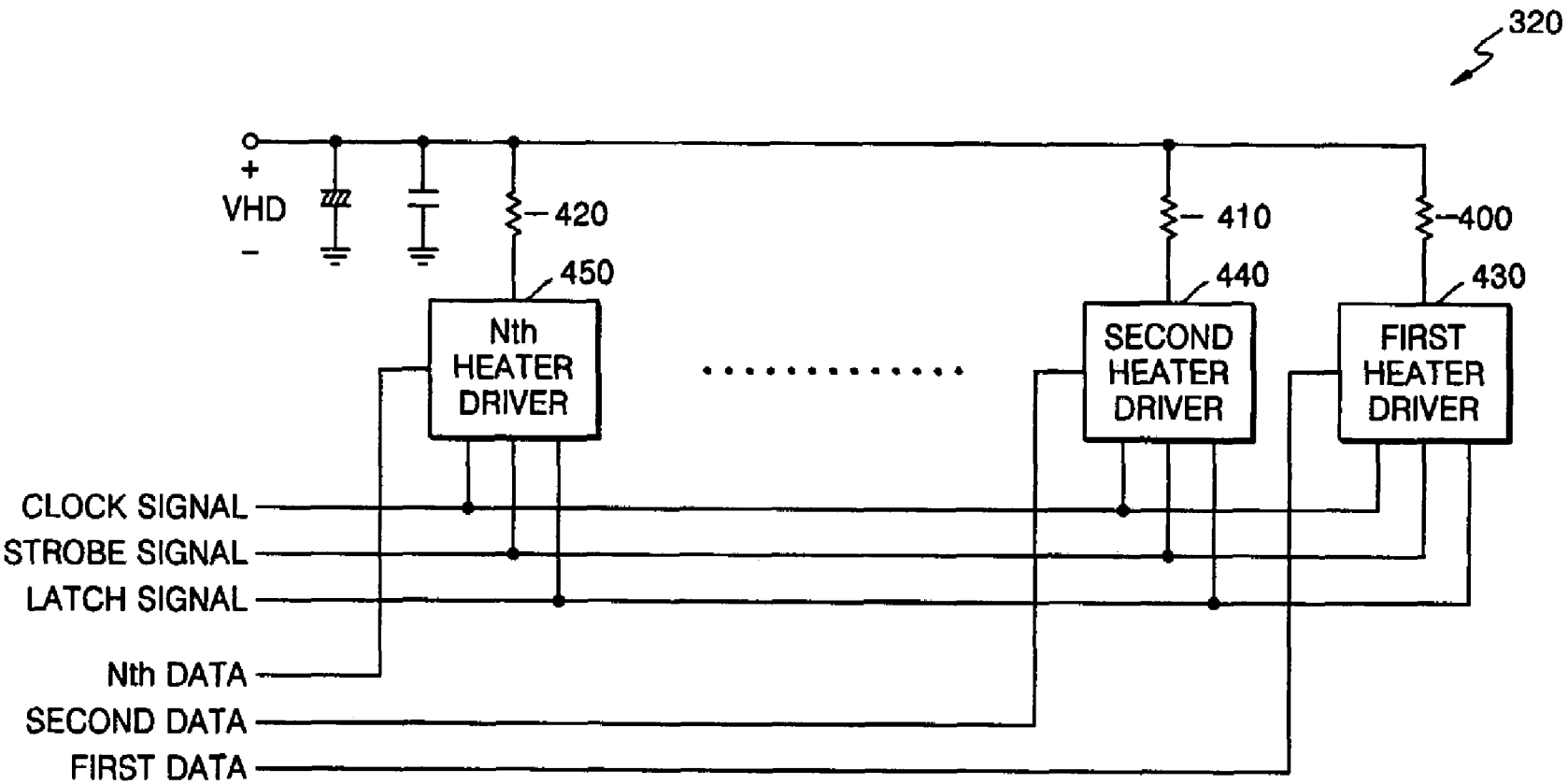
FIG. 4 shows a schematic diagram of a thermal print head illustrated in FIG. 3.

FIG. 4 shows a schematic diagram of the thermal print head 320 illustrated in FIG. 3. The thermal print head 320 includes the plurality of heaters 400, 410, and 420, and a plurality of heater drivers 430, 440, and 450.

The plurality of heaters 400, 410, and 420 apply heat to medium 220, and are driven by the corresponding plurality of heater drivers 430, 440, and 450. For example, a 3-inch, 300 dpi, thermal print head includes 900 heaters that are turned on/off by a corresponding 900 heater drivers. The 900 heaters apply heat to a medium with heat produced by an applied voltage VHD.

Figure 5:
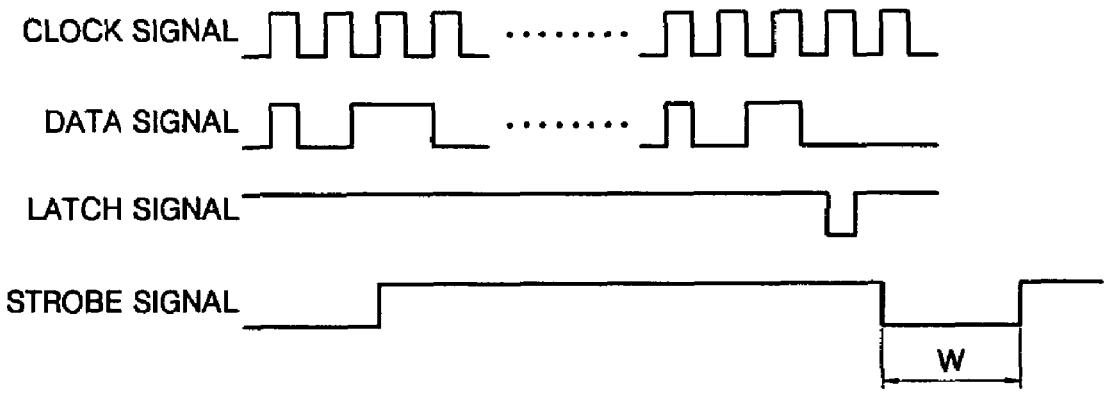
FIG. 5 shows a timing diagram of control signals to drive heaters of the thermal print head.

FIG. 5 shows a timing diagram of the control signals that are input during one gradation to drive heaters 400, 410, and 420 of thermal print head 320. The operations of the thermal print head 320 and the heaters 400, 410, and 420 will be described with reference to FIG. 4. The image data having information on whether heaters 400, 410, and 420 are heated (in other words, on/off) are synchronized to a clock signal, and are input to shift registers (not shown) within the heater drivers 430, 440, and 450. When data from heaters 400, 410, and 420 are input to each corresponding shift register, the data is temporarily stored in flip-flops (not shown) within the heater drivers 430, 440, and 450, corresponding to the heaters 400, 410, and 420, in response to a latch signal, which sets the flip-flops to drive the heaters. When the data stored in each of the flip-flops is high, heaters 400, 410, and 420 apply heat to medium 220 during a time W when a strobe signal is low. Therefore, the time W indicates the time it takes for each of the heaters 400; 410, and 420 to apply heat to medium 220 once.

Figure 6:
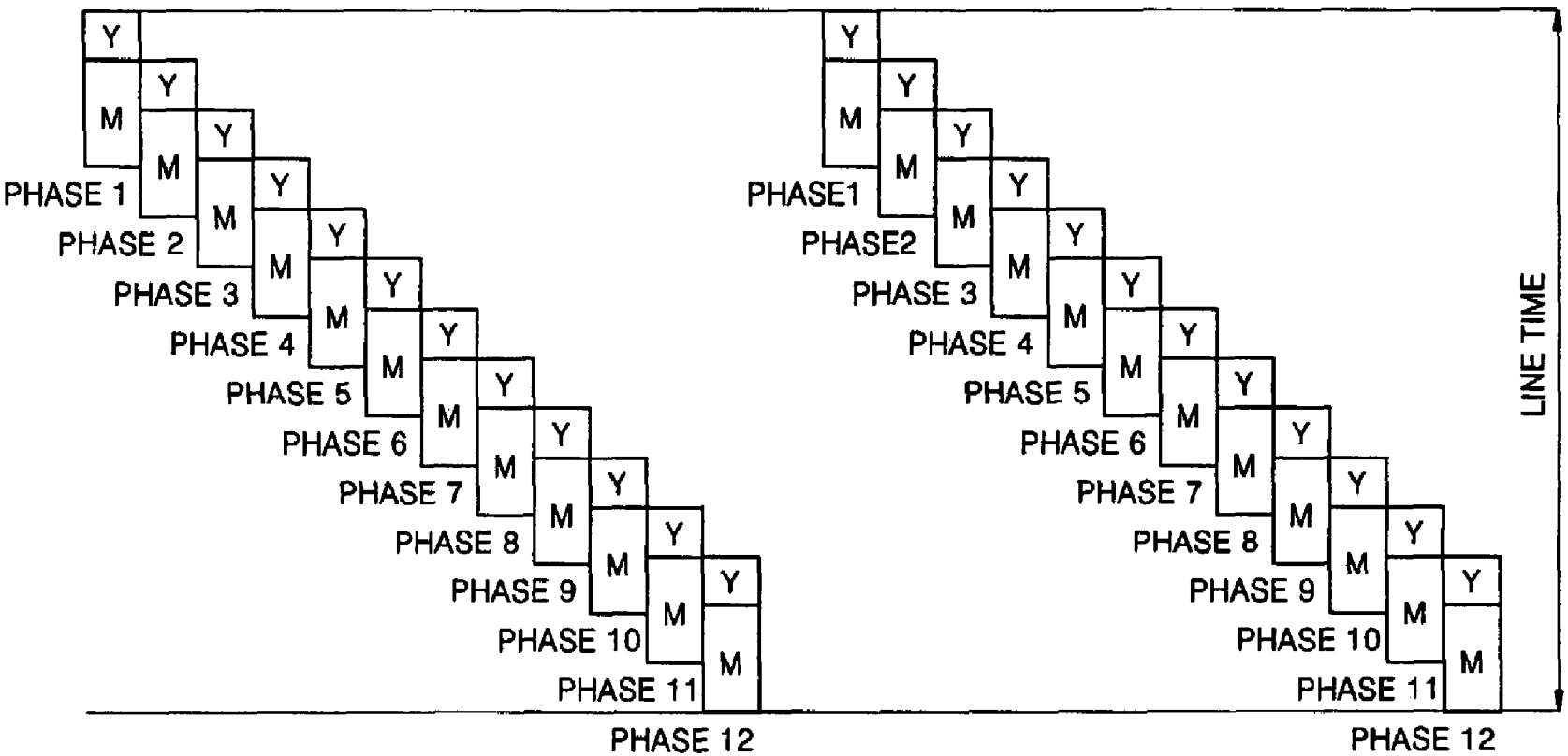
FIG. 6 shows a diagram depicting consecutive printing of yellow and magenta images by dividing the heaters into 12 phases according to an embodiment of the present invention.

FIG. 6 shows a diagram depicting consecutive printing of yellow and magenta images by dividing the plurality of heaters 400, 410, and 420 into 12 phases according to an embodiment of the present invention. An image is formed diagonally on medium 220 as medium 220 is transported. When printing a yellow image and then printing a magenta image, as illustrated in FIG. 6, the plurality of heaters 400, 410, and 420 are divided into groups of 12, and prints an image in 12 phases so that the printing time of a first color, which in some embodiments is yellow (Y), does not overlap with the printing time of a second color, which in some embodiments is magenta (M). When driving the plurality of heaters 400, 410, and 420 by dividing them into phases, power consumption decreases compared to driving all the heaters 400, 410, and 420 simultaneously without dividing them into groups.

Figure 7:
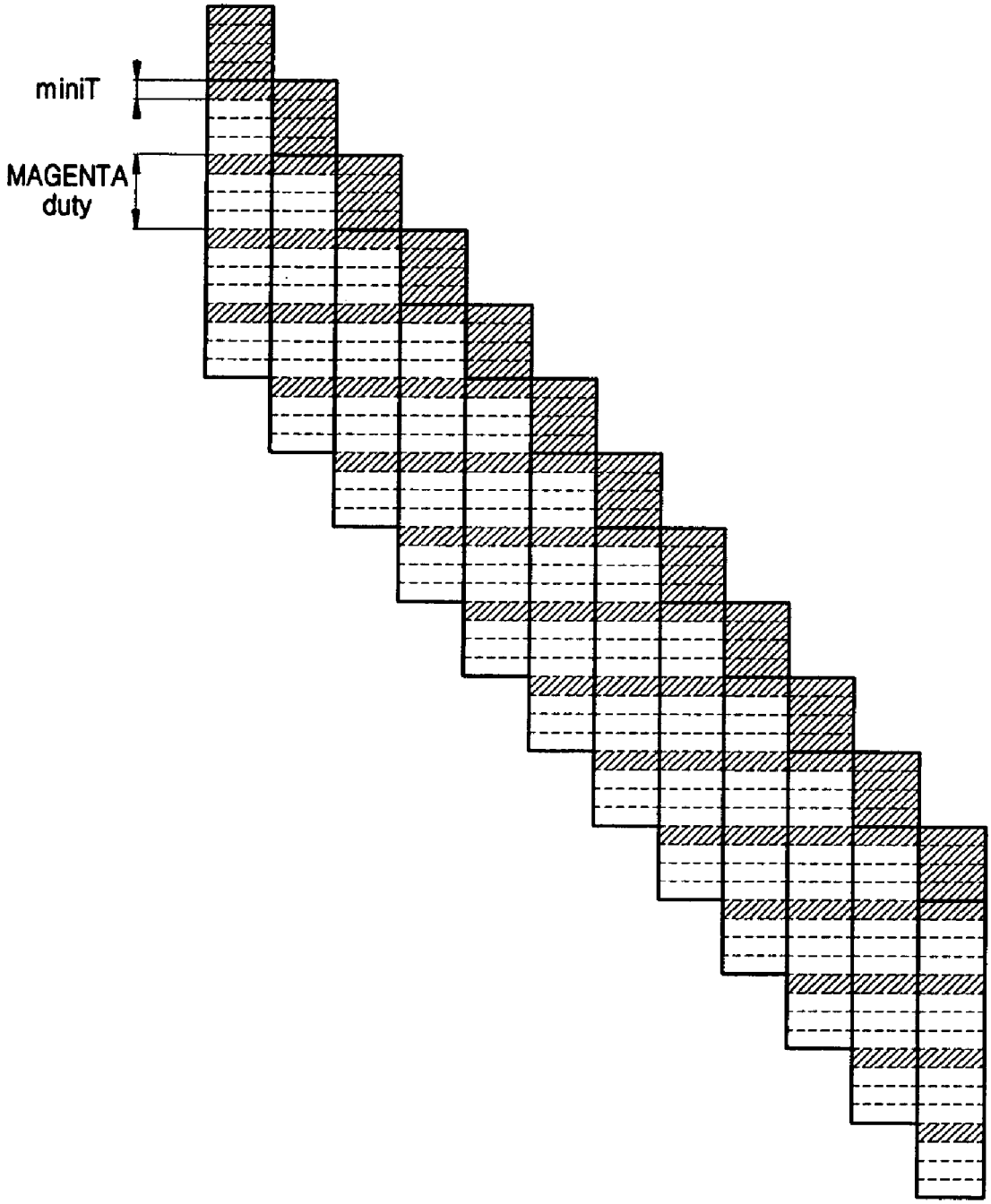
FIG. 7 shows a diagram depicting consecutive printing of yellow and magenta images by dividing the heaters into 12 phases according to another embodiment of the present invention.

FIG. 7 shows a diagram depicting consecutive printing of yellow and magenta images by dividing the plurality of heaters 400, 410, and 420 into 12 phases according to another embodiment of the present invention. FIG. 7 illustrates a single group among the plurality of groups of heaters 400, 410, and 420. Hatched portions illustrate an area to which each of the heaters 400, 410, and 420 apply heat to the medium 220. Referring to FIG. 7, the heater consecutively applies heat to the medium 220 four times to print a yellow image, and the heater sequentially heats four areas of medium 220 at a predetermined distance to print a magenta image. The designation "miniT" denotes a unit of time during which the heater applies heat once to medium 220, and "MAGENTA duty" denotes a cycle when the heater applies heat to medium 220 to print a magenta image. As illustrated in FIG. 7, the magenta duty is 4× miniT.

In the embodiment illustrated in FIG. 7, the heaters are heated a maximum of five times. Thus, if power consumed by the heaters during the heating time is P and the thermal print head 320 includes 1200 heaters, a maximum power of 5×P×100 is used to drive the thermal print head 320. Therefore, the thermal print head 320 can be driven with a power of about 42% of 1200×P, which is a power consumed in simultaneously driving the heaters.

Figure 8:
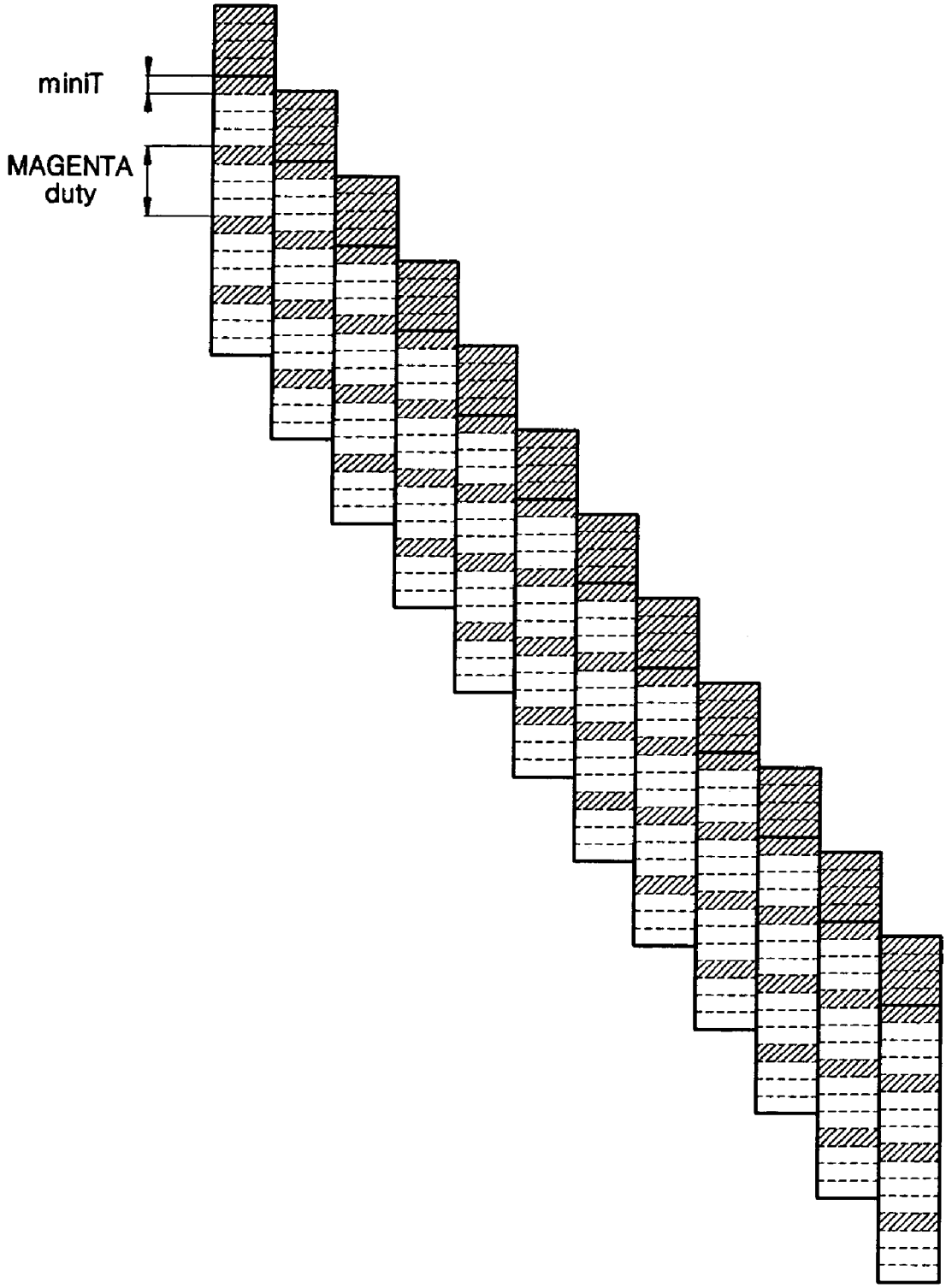
FIG. 8 shows a diagram depicting consecutive printing of yellow and magenta images by dividing the heaters into 12 phases according to another embodiment of the present invention.

FIG. 8 shows a diagram depicting consecutive printing of yellow and magenta images by dividing the plurality of heaters 400, 410, and 420 into 12 phases according to another embodiment of the present invention. In the diagram illustrated in FIG. 8, two adjacent heaters print a magenta image, which is the second color image to be printed in the previous embodiment illustrated in FIG. 7, the magenta image is printed after an interval miniT between a time when printing a yellow image is finished and a time when the magenta image starts to be printed. Thus, the printing time for the magenta image does not overlap with the printing time for the yellow image.

In the embodiment illustrated in FIG. 8, heaters 400, 410, and 420 are heated a maximum of two times. Thus, if power consumed by heaters 400, 410, and 420 during the heating time is P, and the thermal print head 320 includes 1200 heaters, a maximum power of 2×P×100 is used to drive the thermal print head 320. Therefore, the thermal print head 320 can be driven with a power of about 16.7% of 1200×P, which is the power consumed in simultaneously driving heaters 400, 410, and 420.

To adjust the print start time of the yellow image of each of the heaters 400, 410, and 420 in the above described embodiments, offset values having information on the start time of each heater 400, 410, or 420 may be adjusted according to a particular driving order of heaters 400, 410, and 420.

According to the above-described method of driving a thermal print head and image forming apparatus, the heating order of a plurality of heaters are divided into 12 phases and the heaters are sequentially driven to print an image on a medium when printing more than two color images consecutively using the thermal print head. As a result, a power consumed in driving the heaters can be reduced.

Apects of the present invention can also be embodied in a computer readable medium having stored thereon instructions for carrying out the invention. A computer readable medium is any data storage device that can store data and can thereafter be read by a computer system. Examples of a computer readable medium include read-only memory (ROM), random-access memory (RAM), CD-ROMs, magnetic tapes, floppy disks, optical data storage devices, and carrier waves for data transmission. The computer readable medium can also be distributed over network coupled computer systems so that the computer readable instructions are stored and executed in a distributed fashion. Also, functional programs, codes, and code segments for accomplishing the present invention can be easily construed by programmers skilled in the art to which the present invention pertains.

The embodiments above illustrate the thermal print head printing a yellow image and a magenta image consecutively, and then printing a cyan image. However, the present invention can be applied in consecutive printing of any two color images among a yellow image, a magenta image, and a cyan image, or when consecutively printing more than three color images.

While the present invention has been particularly shown and described with reference to exemplary embodiments thereof, it will be understood by those of ordinary skill in the art that various changes in form and detail may be made therein without departing from the spirit and scope of the present invention as defined by the appended claims.

What is claimed is:

1. A method of driving a thermal print head having at least one heater to print an image by applying heat to a medium, the method comprising:

dividing the heaters into a predetermined number of groups, including plural heaters, to consecutively print at least two images; and driving the heaters in each group to sequentially print first and second images, wherein the first and second images are different colors and the printing order of the first and second images is the same for each group.

2. The method of claim 1, the medium comprising a first and second surface, wherein the thermal print head rotates to face the first and second surfaces of the medium.

3. The method of claim 2, wherein the images are color and the thermal print head consecutively prints a yellow image and a magenta image on the first surface of the medium by applying heat to the first surface, and prints a cyan image on the second surface of the medium by applying heat to the second surface.

4. The method of claim 1, the medium comprising a first and second surface, wherein the thermal print head rotates to face the first and second surfaces of the medium.

5. The method of claim 1, wherein the images are color and the first image is a yellow image and the second color image is a magenta image.

6. The method of claim 5, wherein the heaters in each group are driven to sequentially print the yellow image at a predetermined interval.

7. The method of claim 6, wherein the predetermined interval is a unit of time during which the heater applies heat to the medium.

8. The method of claim 6, wherein a latch signal input to the thermal print head is delayed by as much as the predetermined interval so that the heaters can print the yellow image at the predetermined interval.

9. A computer readable medium having stored thereon instructions for driving a thermal print head having one or more heaters that print an image by applying heat to a medium, comprising:

a first set of instructions to control the thermal print head to divide the heaters into a predetermined number of groups, including plural heaters, to consecutively print at least two images; and a second set of instructions to control the thermal print head to divide the heaters in each group to sequentially print first and second images, wherein the first and second images are different colors and the printing order of the first and second images is the same for each group.

10. An image forming apparatus that prints an image using a thermal print head having a plurality of heaters, the image forming apparatus comprising:

a data input unit for receiving data of an image to be printed;

a control unit for generating control signals to drive the heaters according to the image data; and a plurality of heaters that are divided into a predetermined number of groups, wherein the control unit generates the control signals to control the heaters to print at least two images consecutively and to control the heaters of each group to sequentially print first and second images, wherein the first and second images are different colors and the printing order of the first and second images is the same for each group.

11. The image forming apparatus of claim 10, further comprising a location adjusting unit to rotate the thermal print head so that the thermal print head faces a first or second surface of a medium.

12. The image forming apparatus of claim 10, wherein the images are color and the at least two color images are yellow and magenta.

13. The image forming apparatus of claim 12, wherein the control unit generates the control signals to control the heaters in each group to sequentially print the yellow image at a predetermined interval.

14. The image forming apparatus of claim 13, wherein the predetermined interval is a unit of time during which the heater applies heat to the medium.

15. The image forming apparatus of claim 13, wherein the control unit generates a latch signal by delaying it by as much as the predetermined interval so that the heaters can print the yellow image at the predetermined intervals.

* * * * *